United States Patent [19]

Slavik

[11] 4,406,095

[45] Sep. 27, 1983

[54] ATTIC INSULATION VENT

[75] Inventor: Raymond F. Slavik, Albertville, Minn.

[73] Assignee: Minnesota Diversified Products, Inc., New Brighton, Minn.

[21] Appl. No.: 292,638

[22] Filed: Aug. 13, 1981

[51] Int. Cl.[3] ..... E04B 7/18

[52] U.S. Cl. ..... 52/95; 52/90; 52/404; 52/407; 98/37; 98/42 R; 98/DIG. 6

[58] Field of Search ..... 52/90, 92, 95, 199, 52/198, 94, 406, 407, 222, 404; 98/32, 37, 42, 42 A, 42 R, DIG. 6

[56] References Cited

U.S. PATENT DOCUMENTS

| | | | |
|---|---|---|---|
| 1,848,272 | 3/1932 | Powell | 52/407 |
| 3,141,206 | 7/1964 | Stephens | 52/406 |
| 3,972,164 | 8/1976 | Grange | 52/95 |
| 4,096,790 | 6/1978 | Curran | 98/42 R X |
| 4,102,092 | 7/1978 | Ward | 52/95 |
| 4,197,683 | 4/1980 | Ward | 52/95 |
| 4,214,510 | 7/1980 | Ward | 52/95 |
| 4,237,672 | 12/1980 | Peterson | 52/92 |
| 4,265,060 | 5/1981 | Woodhams | 52/92 |

*Primary Examiner*—John E. Murtagh
*Assistant Examiner*—Richard E. Chilcot, Jr.
*Attorney, Agent, or Firm*—Kinney, Lange, Braddock, Westman and Fairbairn

[57] ABSTRACT

In a house structure in which insulated material is placed between and over attic floor joists, an insulation vent provides an air channel to allow free flow of ventilating air along the underside of roof sheathing between the exterior soffit and the interior of the attic above the insulating material. The vent is molded of one piece of expanded polystyrene. The vent has a base with longitudinal ribs, a pair of walls extending upward at an angle, and a pair of flanges extending outward from the edge of the wall, for attachment to the roof joists. The cross section of the vent is generally U-shaped. The vent is installed by flexing the walls inward, inserting the vent between a pair of roof joists and against the roof sheathing, and releasing the walls. The walls expand, pushing the flanges against a pair of roof joists. Friction holds the vent in place. The center of the U forms a channel for the passage of air.

2 Claims, 4 Drawing Figures

ATTIC INSULATION VENT

BACKGROUND OF THE INVENTION

1. Field of the Invention

This invention relates to devices for venting outside air along the underside of roof sheathing to a point above the attic insulation layer.

2. Description of the Prior Art

It is well known in the prior art that a flow of air on the underside of roof sheathing will improve insulation efficiency and reduce the buildup of moisture in insulating material. Circulating air also helps prevent ice dams on the roof. An ice dam develops when water flows from a warm area of a roof down to a colder area where it freezes. As more water freezes, a dam develops which prevents water from flowing past the point. This water can back up under shingles and leak into the attic. It can then soak into insulation and decrease its efficiency. It can also leak into the interior of the building and cause structural and cosmetic damage. One cause of such damming is heat moving through the roof to melt ice. The water melted from the ice then flows down to form a dam at a lower, colder place. It is known that cool outside air circulating under the roof sheathing helps to prevent such ice melting.

The Uniform Building Code Section 320.5 requires venting along the underside of roof sheathing.

Many types of devices have been developed which allow air circulation under the roof sheathing. It is also known in the prior art to mold one piece, closed cell, expanded polystyrene vents which can be applied to roof sheathing to form an air channel from under the eave to a point in the attic above a level of insulation. In the prior art, these one piece polystyrene vents were nailed or stapled to the roof sheathing. This resulted in many damaged or destroyed vents because of errant blows of a hammer or stapler. Once cracked, a vent can become useless, if, during installation, insulation is blown or otherwise forced up into the vent. This will block air flow.

Polystyrene vents in the prior art including flat panels parallel to the roof sheathing also suffered damage and reduction of air space when insulation forced in the attic area below them bowed the bottom surface of the vent upward. Polystyrene is a preferred material for such a vent because it provides insulation as well as an air barrier. A flat polystyrene panel is not strong enough, however, to withstand the pressure of insulation blown or otherwise forced against it.

SUMMARY OF THE INVENTION

An attic insulation vent fits between a pair of adjacent roof rafters against the underside of roof sheathing. The vent is held in place between the rafters by friction. The vent has a rectangular channel base with longitudinal ribs. A pair of resilient walls integral with the channel base each extend upward at a diverging angle to the plane of the base on two opposite sides of the base. Flanges, one integral with each wall, extend outward from each wall in a plane parallel to the plane of the base. To install the vent, the walls are flexed inwardly. The vent is then moved up against the underside of the roof sheathing and the walls are released. The walls flex outward and press the flanges against the sides of the adjacent roof rafters. The friction of the flange against the rafter holds the vent in place.

The longitudinal ribs stiffen the channel base and prevent bowing when insulation presses against the bottom of the base.

DETAILED DESCRIPTION OF THE PREFERRED EMBODIMENT

Figure 1:
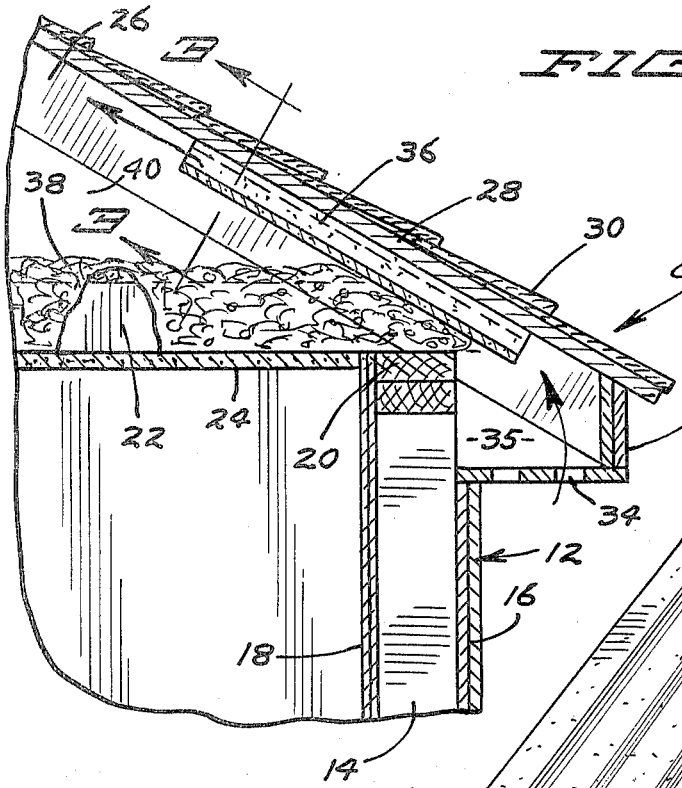
FIG. 1 is a fragmentary cross sectional view of a portion of a frame building showing an attic insulation vent of the invention mounted at the intersection of an outside wall, attic floor joist, and roof rafters.

A corner of a frame building 10 is illustrated in FIG. 1. A wall 12 of that building comprises vertical studs 14, exterior wall sheathing 16, interior wall board 18, and horizontal wall plate 20. Studs 14 and wall plate 20 are made of standard two-by-four construction lumber. Wall plate 20 as shown is, as usual, made up of a pair of two-by-fours. Attic floor joists 22 rest on top of and are attached to wall plate 20. Ceiling 24 is supported from the underside of floor joists 22. Ceiling 24 is plasterboard or any other ceiling material.

Roof rafters 26 rest at an acute angle on wall plate 20. Roof rafters 26 are notched to fit the wall plate 20. Roof sheathing 28 is nailed to the top of roof rafters 26, and roofing 30 is nailed to the sheathing.

Figure 3:
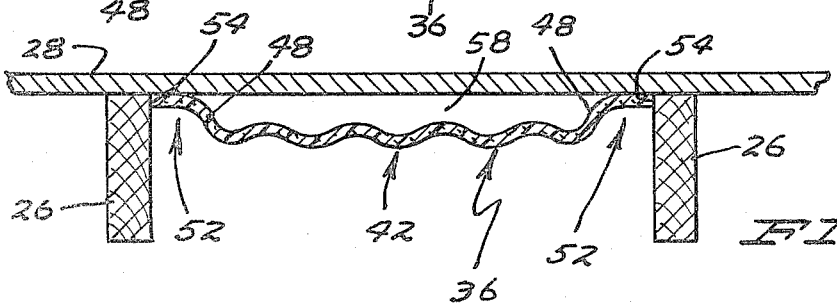
FIG. 3 is a cross sectional view taken on the line 3—3 of FIG. 1 showing the attic insulation vent of FIG. 2 in its installed position.

A fascia board 32 is nailed across the ends of roof rafters 26. Horizontal vented soffit 34 is mounted between fascia board 32 and wall sheathing 16. Fascia 32, vented soffit 34 and roof sheathing 28 form an enclosed eave space 35. In FIGS. 1 and 3, attic insulation vent 36 of the invention is shown mounted between a pair of roof rafters 26 and against roof sheathing 28. Bulk insulation 38 is blown or otherwise forced to fill the area between and above floor joists 22. Insulation 38 commonly is piled to a height above floor joists 22 and is shown contacting the underside of insulation vent 36. Ventilating air flows in the path shown by arrows in the figure. Outside air enters eave area 35 through vented soffit 34 and travels upward through insulation vent 36 into an open attic space 40. This open attic space 40 is commonly vented out the end of the attic wall (not shown) or elsewhere to allow an outward flow of air.

Figure 4:
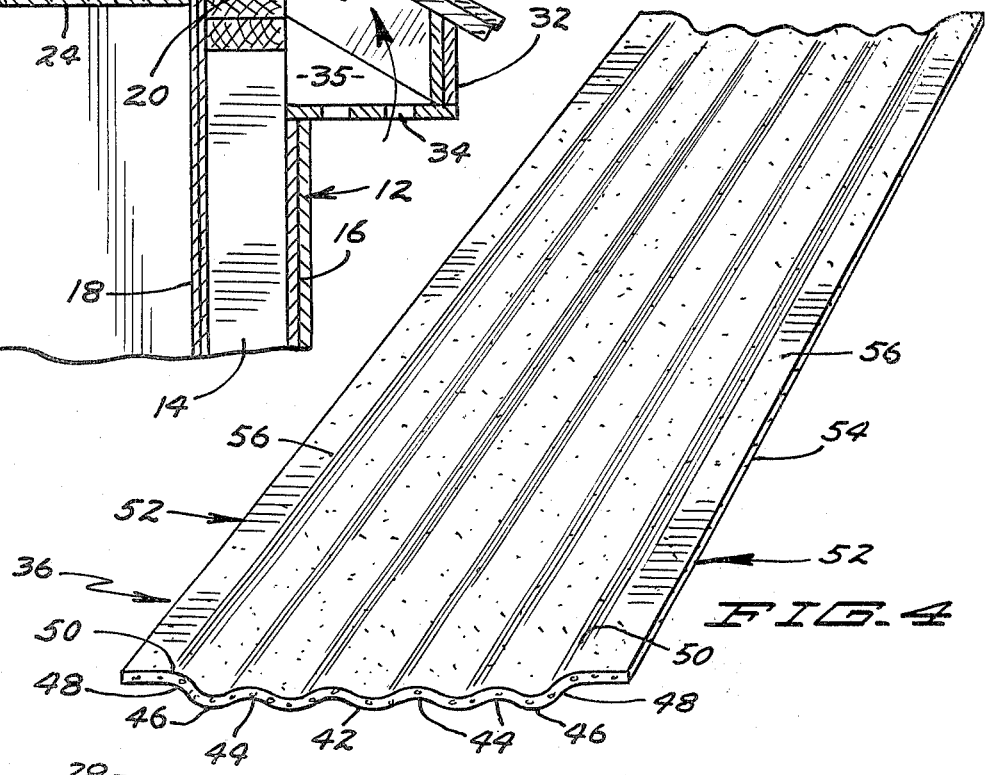
FIG. 4 is a perspective view of an attic insulaton vent of the invention.

As shown in FIG. 4, vent 36 has a generally rectangular channel base 42 which is provided with a plurality of longitudinally extending stiffening ridges 44. Extending integrally upward from each side 46 of channel base 42 is a vent wall 48. Each wall 48 lies at an upwardly diverging angle to channel base 42. Extending outward from and integral with an upper edge 50 of each wall 48 is a flange 52. Each flange 52 has a longitudinally extending side face 54 for frictionally contacting a roof rafter 26 and an upper surface 56 for contacting roof sheathing 28.

The ribs 44 in channel base 42 provide stiffening for the vent. The ribs prevent bowing of the channel base 42 when insulation 38 presses against the lower surface of the channel base. If base 42 were to be deformed upward toward roof sheathing 28, the effective air space would be reduced and the vent rendered less effective. There would also be a danger of the insulation vent breaking if channel base 42 were flexed upward. The ribs 44 effectively prevent such deformation.

Vent 36 is preferably molded of semi-resilient, one piece of semi-rigid, foamed closed-cell expanded polystyrene. Vents are preferably sized to frictionally fit between standard spaced roof rafters, such as sixteen or twenty-four inches on center.

Figure 2:
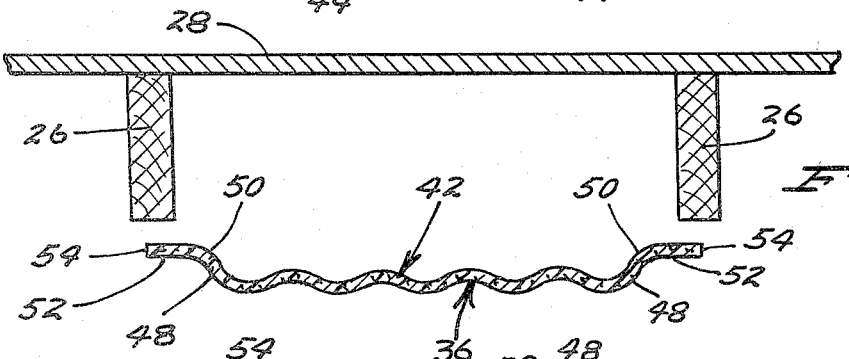
FIG. 2 is a cross sectional view of a pair of adjacent roof rafters and sheathing, and an attic insulation vent in a position prior to installation.

FIG. 2 shows the insulation vent 36 in position for installation next to a pair of roof rafters 26. To install the vent 36, vent walls 48,48 are bent inward so that flanges 52,52 will fit between the rafters 26. The vent 36 is then moved upward between the rafters to a position as shown in FIG. 3. Walls 48,48 are then released so that side surfaces 54,54 of flanges 52,52 press against the roof rafters 26,26. In the installed position shown in FIG. 3, the tension of the pair of flanges 52,52 against roof rafters 26 holds the vent permanently in place. Upper surfaces 56,56 of flanges 52,52 are against the roof sheathing 28. This provides a predetermined proper amount of venting area 58 between vent 36 and roof sheathing 28.

A vent constructed according to the present invention solves two persistent problems in venting using polystyrene vents. The friction fit in this model eliminates the need for nailing or stapling and thereby prevents the loss of many vents due to missed hammer blows. There is no risk of the polystyrene splitting due to improper staple or nail insertion. Installation of the friction fit vent is also faster than previous methods; and the saving in the man-hours is substantial.

The second problem solved is that of deformation of the polystyrene vent due to the pressure of the insulation below it. The ribbed base in a vent constructed according to the present invention will not flex upward as did prior art polystyrene vents. This maintains the proper air space along the roof sheathing and prevents breakage of the vent.

Although the present invention has been described with reference to preferred embodiments, workers skilled in the art will recognize that changes may be made in form and detail without departing from the spirit and scope of the invention.

What is claimed is:

1. An attic insulation vent for use in a house having an enclosed room partially defined by an outer wall, a horizontal upper wall plate, and spaced-apart attic floor joists supported above the wall plate, a room ceiling depending from the joists, parallel inclined roof rafters, spaced from each other by a predetermined distance, supported above the wall plate and extending beyond the outer wall, roof sheathing fastened on upper edges of the rafters, and insulating material covering the ceiling to a substantial depth, the insulation vent providing an air passage free of insulating material between a pair of adjacent roof rafters and along the underside of the roof sheathing from outside of the wall sheathing to well above the depth of the insulating material; the insulation vent being made of semi-rigid, semi-resilient, foamed, closed cell polymer, the vent including:

a rectangular channel base generally defining a plane, having two sides lying in the plane and a plurality of longitudinal ribs extending out of said plane;

a pair of walls integral with the channel base and extending divergingly upward and outward from the channel base sides at an acute angle to the plane of the base;

a flange integral with each wall and extending outward in a plane generally parallel to the plane of the base, having anupper surface for contacting roof sheathing and a side face for frictionally contacting a roof rafter; and the transverse distance between said vent flanges side faces being nominally greater than the predetermined distance between said roof rafters, said vent being sufficiently deformable to position said vent flange side faces at said predetermined distance when said vent is installed between said roof rafters and against said roof sheathing, and the vent, when so installed, being sufficiently rigid to hold itself in said installed position.

2. The insulation vent of claim 1 wherein the polymer is polystyrene.

* * * * *